US011325337B2

(12) United States Patent
Luviano et al.

(10) Patent No.: US 11,325,337 B2
(45) Date of Patent: May 10, 2022

(54) METHOD FOR COMPACTLY FOLDING PAPER AND PRODUCT

(71) Applicant: Platinum Press, Inc., Fort Worth, TX (US)

(72) Inventors: Ruben Luviano, Fort Worth, TX (US); Tom Miller, Fort Worth, TX (US)

(73) Assignee: Platinum Press, Inc., Fort Worth, TX (US)

( * ) Notice: Subject to any disclaimer, the term of this patent is extended or adjusted under 35 U.S.C. 154(b) by 0 days.

(21) Appl. No.: 16/476,036

(22) PCT Filed: Sep. 14, 2018

(86) PCT No.: PCT/US2018/051172
§ 371 (c)(1),
(2) Date: Jul. 3, 2019

(87) PCT Pub. No.: WO2020/055430
PCT Pub. Date: Mar. 19, 2020

(65) Prior Publication Data

US 2021/0331439 A1 Oct. 28, 2021

(51) Int. Cl.

| | |
|---|---|
| ***B65H 45/30*** | (2006.01) |
| ***B31D 5/04*** | (2017.01) |
| ***B42D 15/00*** | (2006.01) |
| ***B65H 45/20*** | (2006.01) |

(52) U.S. Cl.
CPC ..... *B31D 5/04* (2013.01); *B42D 15/008* (2013.01); *B65H 45/20* (2013.01); *B65H 45/30* (2013.01); *B65H 2701/11231* (2013.01); *B65H 2701/11238* (2013.01)

(58) Field of Classification Search
None
See application file for complete search history.

(56) References Cited

U.S. PATENT DOCUMENTS

| | | | | |
|---|---|---|---|---|
| 3,610,243 | A | 10/1971 | Jones, Sr. | |
| 5,593,755 | A | 1/1997 | Fuss | |
| 5,909,899 | A | 6/1999 | Vijuk et al. | |
| 6,273,411 | B1 * | 8/2001 | Vijuk | B42D 15/008 270/37 |
| 7,247,130 | B2 * | 7/2007 | Matti | B31D 1/022 493/379 |

(Continued)

OTHER PUBLICATIONS

International Search Report issued in corresponding application No. PCT/US2018/051 172 dated Jan. 16, 2019 (2 pages).

(Continued)

*Primary Examiner* — Leslie A Nicholson, III
(74) *Attorney, Agent, or Firm* — Ferguson Braswell Fraser Kubasta PC

(57) ABSTRACT

A method of folding a sheet of paper. The method includes: folding the sheet of paper into an accordion shape comprising a plurality of pleats and collapsing the pleats to form a strip; folding the strip about in half to form a first folded strip; folding the first folded strip about a point that is about two-thirds a length of the first folded strip to form a second folded strip comprising an exposed portion that is about a third the length of the first folded strip; and folding the second folded strip about in half to form a third folded strip.

20 Claims, 8 Drawing Sheets

(56) References Cited

U.S. PATENT DOCUMENTS

| | | | | |
|---|---|---|---|---|
| 8,485,558 | B2 * | 7/2013 | Neubauer | B65H 45/142 283/67 |
| 10,363,766 | B2 * | 7/2019 | Lacek | B65H 45/142 |
| 10,793,330 | B2 * | 10/2020 | Bokovza | B65D 71/06 |
| 2005/0136531 | A1 | 6/2005 | Sosalla et al. | |
| 2007/0207910 | A1 | 9/2007 | Neubauer et al. | |

OTHER PUBLICATIONS

Written Opinion of the International Searching Authority issued in corresponding application No. PCT/US2018/051172 dated Jan. 16, 2019 (7 pages).

* cited by examiner

METHOD FOR COMPACTLY FOLDING PAPER AND PRODUCT

This application is the national stage filing of Patent Cooperation Treaty (PCT) application PCT/US2018/51172, filed Sep. 14, 2018.

BACKGROUND

In the pharmaceutical industry, purchased medication is often provided with printed drug information sheets, otherwise known as package inserts/outserts. Package inserts/outserts may be quite lengthy, possibly taking up many pages of ordinary paper printed with, for example, double line spacing using a 12-point font.

To more efficiently and compactly deliver the information to the physician or patient, smaller font types with reduced line spacing can be printed on thinner paper. However, a practical limit to font size, line spacing, and paper thickness exists because the package insert/outsert is meant to be read by a person holding the paper. Additionally, package inserts/outserts are often printed on a single page of non-standard sized paper. When the package insert/outsert is attached to a relatively small (hand-held) drug container, such as a bottle or box, the size of the drug information sheet can become unwieldy and can take up an undesirable amount of storage or shelf space.

SUMMARY

In general, in one aspect, one or more embodiments relate to a method of folding a sheet of paper. The method includes: folding the sheet of paper into an accordion shape comprising a plurality of pleats and collapsing the pleats to form a strip; folding the strip about in half to form a first folded strip; folding the first folded strip about a point that is about two-thirds a length of the first folded strip to form a second folded strip comprising an exposed portion that is about a third the length of the first folded strip; and folding the second folded strip about in half to form a third folded strip.

In another aspect, one or more embodiments relate to a product created according to a process comprising: folding the sheet of paper into an accordion shape comprising a plurality of pleats; collapsing the pleats to form a strip; folding the strip about in half to form a first folded strip; folding the first folded strip about a point that is about two-thirds a length of the first folded strip to form a second folded strip comprising an exposed portion that is about a third the length of the first folded strip; and folding the second folded strip about in half to form a third folded strip.

In another aspect, one or more embodiments relate to a product. The product includes a sheet of folded paper comprising: an accordion fold, wherein the accordion fold comprises a strip of a plurality of collapsed pleats, a first fold around about a center of the strip, a second fold within the first fold at about a two-thirds of a first length of the first fold of the strip, and a third fold within the second fold at about a half of a second length of the second fold of the strip.

In another aspect, in a variation, prior to folding the second folded strip, a first spot of glue may be applied to the exposed portion of the second folded strip. In still another aspect, in a variation, a second spot of glue may be applied on the third folded strip. In yet another aspect, in a variation, after applying the second spot of glue, the third folded strip may be folded about in half to form a fourth folded strip, the fourth folded strip being three rounded edges at one end and a single rounded edge at an opposite end.

Other aspects of the invention will be apparent from the following description and the appended claims.

DETAILED DESCRIPTION

Figure 1:
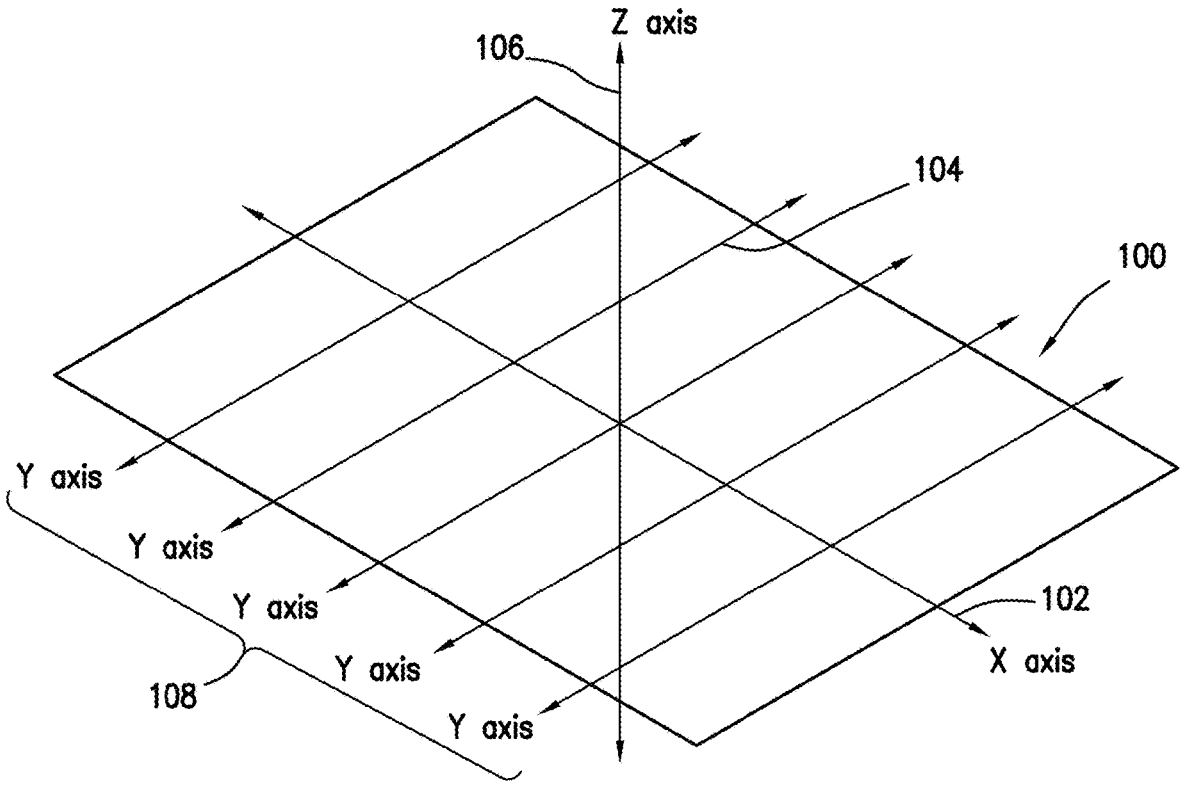
FIG. 1 shows a sheet of paper with axes drawn for reference, in accordance with one or more embodiments.

Specific embodiments will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or proceed) the second element in an ordering of elements.

Further, although the description includes a discussion of various embodiments of the invention, the various disclosed embodiments may be combined in virtually any manner. All combinations are contemplated herein.

As used herein, the terms "substantially parallel" or "about parallel" are defined as mathematically parallel to a precision that an ordinary artisan would consider to be reasonably satisfactory for an intended folding pattern. As a non-limiting example, an edge is "substantially parallel" to another edge when an ordinary person using only visual inspection would reasonably judge the edges to be parallel. As another non-limiting example, two fold lines are "substantially parallel" when the fold lines are parallel to within several millimeters deviation from true parallel. As another non-limiting example, two fold lines are "substantially parallel" when, after folding is complete, variations from true parallel still result in an exposed portion for placing a glue spot inside the fold, with the "exposed portion" being defined below with respect to exposed portion (506) of FIG. 5.

As used herein, the terms "substantially perpendicular", "about perpendicular", "substantially orthogonal," and "about orthogonal" are defined as mathematically perpendicular to a precision that an ordinary artisan would consider to be reasonably satisfactory for an intended folding pattern. As a non-limiting example, an axis is "substantially perpendicular" to another axis when an ordinary person using only visual inspection would reasonably judge the axes to be perpendicular. As another non-limiting example, two axes are "substantially perpendicular" when the axes are perpendicular to within less than several millimeters deviation from true orthogonality. As another non-limiting example, two fold lines are "substantially perpendicular" when, after folding is complete, variations from true perpendicular still result in an exposed portion for placing a glue spot inside the fold, with the "exposed portion" being defined below with respect to the exposed portion (506) of FIG. 5.

As used herein, the terms "about" or "substantially" used with fractions indicate deviations from the indicated relative fold position that an ordinary artisan would consider to be reasonably acceptable for an intended folding pattern. As a non-limiting example, the term "about in half" means that an ordinary artisan would understand that a piece of paper is folded in the middle of the paper about the appropriate axis, with the "middle" being within a reasonably acceptable deviation from the true center of the paper. As another non-limiting example, the term "folded about in half" for a square sheet of paper means matching two opposing edges and then forming a fold line along the axis that goes through a center point of the piece of paper, with the fold line being within a reasonable deviation from a true center of the paper. As yet another non-limiting example, folded "about in half" means the fold line is within several millimeters of a true center line of the piece of paper. As yet another non-limiting example, folded "about in half" means the fold line, after folding is complete, still results in an exposed portion for placing a glue spot inside the fold despite variations from folding exactly in half, with the "exposed portion" being defined below with respect to the exposed portion (506) of FIG. 5. As a still different non-limiting example, folded "about two thirds" means that the folding axis is located a distance from an edge of the sheet of paper equal to two-thirds the length of the sheet of paper, and is in that position to a precision that an ordinary artisan would consider to be reasonably acceptable for the intended folding pattern.

As used herein, the terms "substantially equal" or "about equal" means equal to a degree of precision that an ordinary artisan would consider to be reasonably acceptable for a particular folding pattern. As a non-limiting example, "about equal" may be within several millimeters of absolute equality. As yet another non-limiting example, folded "about equal" means that, after folding is complete, an exposed portion remains for placing a glue spot inside the fold despite variations from true equality, with the "exposed portion" being defined below with respect to the exposed portion (506) of FIG. 5.

As used herein, the terms "substantially" or "about", when used in conjunction with a dimension of a sheet of paper, mean a measurement of the dimension to a precision deemed reasonably acceptable to an ordinary artisan for a particular folding pattern. As a non-limiting example, "about X centimeters" may mean a measurement that is precise to within several millimeters of the value of X. As yet another non-limiting example, the terms "substantially" or "about", when used in conjunction with a dimension of a sheet of paper, mean, after folding is complete, an exposed portion remains for placing a glue spot inside the fold despite variations from folding according to the recited dimensions, with the "exposed portion" being defined below with respect to the exposed portion (506) of FIG. 5.

As used herein, the term "substantially flat" or "about flat" means planar to a degree of precision that an ordinary artisan would consider to be reasonably acceptable for a piece of paper for a particular folding pattern. As a non-limiting example, a piece of paper is "substantially flat" if its surfaces are planar to within one percent of a thickness of the paper. As yet another non-limiting example, the terms "substantially flat" or "about flat" mean, after folding is complete, an exposed portion remains for placing a glue spot inside the fold despite variations from being perfectly flat, with the "exposed portion" being defined below with respect to the exposed portion (506) of FIG. 5.

Attention is now drawn to the description of the figures. The use of the term FIG. or Figure is interchangeable and refers to corresponding drawings labeled as such.

One or more embodiments relate to a method of folding a sheet of paper incorporating two or more gluing units to produce a more compressed package insert/outsert. The method includes: parallel folding the sheet of paper in an accordion-style pattern comprised of a plurality of folds forming a strip; diverting the strip perpendicularly to the initial parallel fold; folding the strip about in half to form a first folded strip; folding this first folded strip at a point that is about two-thirds the length of the first folded strip exposing an area of the strip that is about a third the length of the first folded strip forming a second folded strip; applying one or more glue spots to the exposed area within in the second folding unit; folding the second folded strip about in half; applying one or more glue spots to the exposed area within in the third folding unit; and forming a third folded piece known as a package outsert. This exemplary method is only one particular embodiment; other methods are also possible with more or fewer steps, or variations on the steps in this example. Accordingly, this exemplary method does not necessarily limit the claimed inventions, or the other examples provided herein.

FIG. 1 illustrates a flat sheet of paper (100) shown with Cartesian axes, although one skilled in the art may use different coordinate systems, to describe directions with respect to the sheet of paper (100). A Cartesian system is coordinate system that specifies each point uniquely in a plane generally by a pair (or tuple) of numerical coordinates (typically an X-axis and a Y-axis or sometimes and X-axis, Y-axis, and Z-axis), which are the signed distances to the point from two fixed perpendicular directed lines, measured in the same unit of length. FIG. 1 shows three orthogonal primary axes, including X-axis (102), Y-axis (104), and Z-axis (106). X-axis (102) and Y-axis (104) lie in the plane of the sheet of paper (100), while Z-axis (106) extends directly into and out of the sheet of paper (100).

Multiple axes may be referenced, depending on the types of folds desired. For example, multiple Y axes (108) may all be substantially parallel to the primary Y-axis (104) and orthogonal to both the X-axis (102) and the Z-axis (106). Additionally, multiple parallel axes may be present in both the X and Z directions.

Note that the axes (X-axis (102), Y-axis (104), Z-axis (106), multiple Y axes (108), etc.) may be re-labeled, or the sheet of paper (100) may be turned in various orientations, and thus the labels "X", "Y", and "Z" do not imply absolute orientations and do not exclude other axis labels or views of the same sheet of paper. Thus, for example, the various examples provided herein, and the claims below, should not be interpreted as requiring the exact axis orientations shown. The various folding patterns could be re-cast along different axes depending on the orientation of the sheet of paper (100).

The sheet of paper (100) may be provided in various dimensions, shapes, sizes, and thicknesses. As a non-limiting example, the sheet of paper (100) may be about 68 centimeters (about 27 inches) by about 48 centimeters (about 19.25 inches) and about 50 micrometers (0.002 inches) thick. However, the folding patterns described herein may be applied to sheets of paper having many different dimensions, shapes, sizes, and thicknesses. The spacing of multiple folding axes may be adjusted as desired, such as to accommodate specific figures or font sizes printed on the sheet of paper (100). Although the multiple Y axes (108) are preferably about equally spaced, in some embodiments the spacing of one or more of the multiple Y-axes (108) may be adjusted relative to others of the multiple Y axes (108).

FIG. 2 through FIG. 7A show an example of an improved paper folding pattern. This example assumes that a sheet of paper starts substantially flat, such as the sheet of paper (100) of FIG. 1. However, the starting point of the example provided below may also be a sheet of paper that has already been pre-folded one or more times and returned to a substantially flat condition, or possibly the starting point may be a pre-folded sheet of paper.

Figure 2:
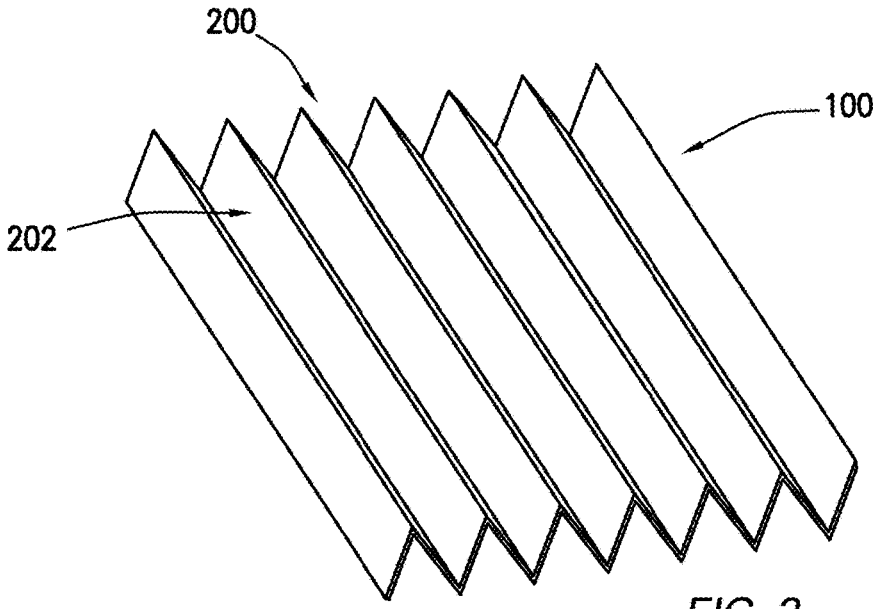
FIG. 2, FIG. 3, FIG. 4, FIG. 5, FIG. 6, and FIG. 7A show various stages of folding a sheet of paper, in accordance with one or more embodiments.
Figure 3:
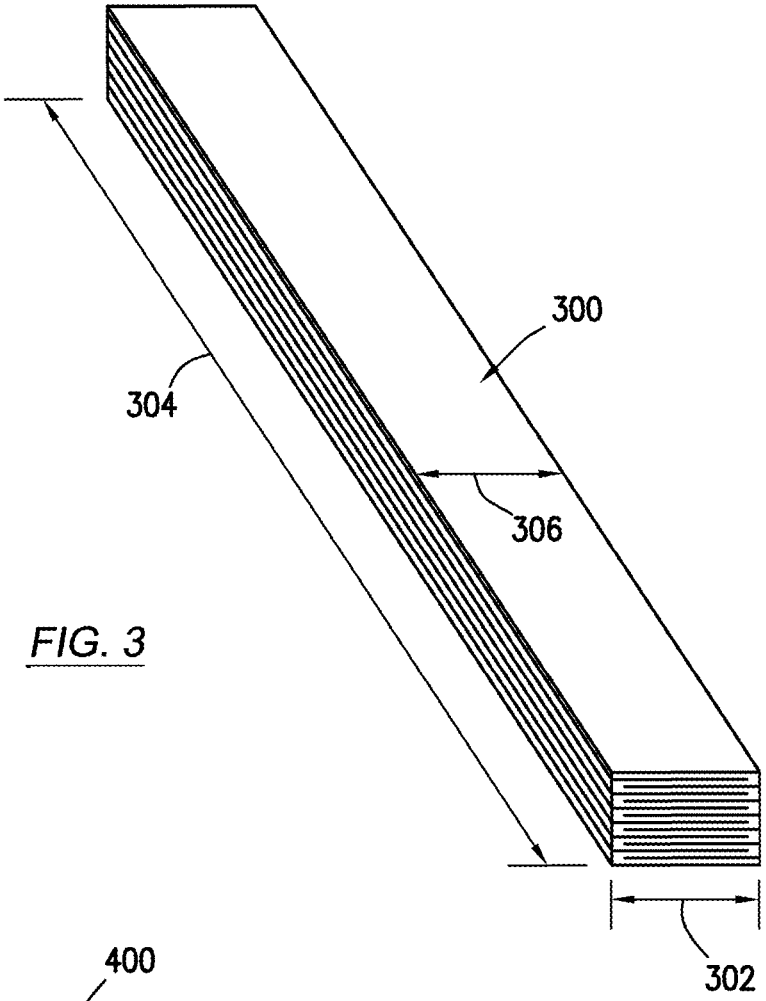

In particular, FIG. 2 and FIG. 3 together show a single folding step performed at a single station in a folding machine. However, FIG. 2 and FIG. 3 are shown separately so that the manner in which the sheet of paper (100) of FIG. 1 is folded into strip (300) of FIG. 3 can be seen more readily.

FIG. 2 shows an intermediate stage of the first folding step. The sheet of paper (100) is folded along multiple parallel axes in order to form an accordion-style fold (referred to as accordion fold (200)) having multiple pleats, such as pleat (202). In one or more embodiments, this type of accordion fold (200) may be referred-to as a "parallel-fold". As part of the first folding step, the multiple pleats are collapsed to form strip (300) of width (302) and length (304). Collapsing the multiple pleats may be accomplished by pressing the pleats of the accordion fold (200) together, possibly simultaneously with forming the pleats.

FIG. 3. shows the results of the first folding step. Not all pleats within the strip (300) need be the same width. For example, a final pleat corresponding to one or more edges of the sheet of paper (100) may have a width less than the other pleats.

In an embodiment, the accordion fold (200) is performed in a first folding station of a folding machine. The accordion fold (200) is passed to a second station in the folding machine in which the next folding mechanism is orthogonal to the orientation of the accordion fold. In this manner, the strip (300) may be folded about axis (306), as shown in FIG. 3. In an alternative embodiment, the accordion fold (200) may be dispensed from a parallel folding section of a folding machine in a multitude of configurations for additional folding. Thus, the angle at which the accordion fold (200) is folded in the next machine section may be varied in one or more embodiments.

Figure 4:
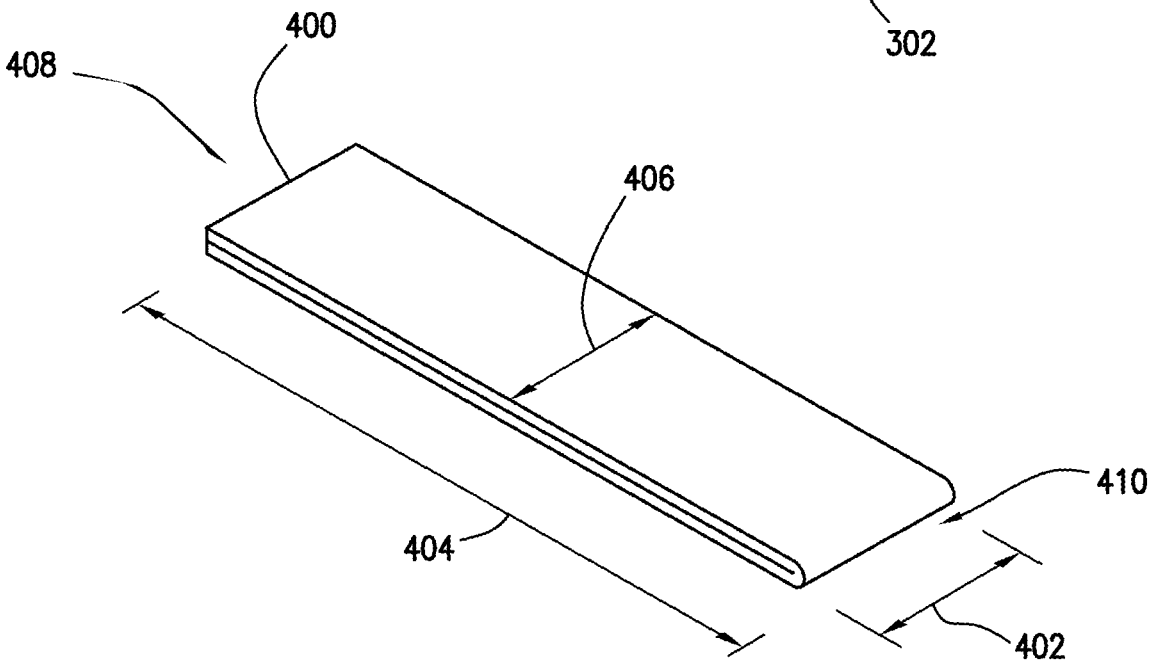

FIG. 4 shows the results of a second folding step. In the second folding step, the strip (300) of FIG. 3 is folded about in half to form strip (400) of width (402) and length (404). In other words, the strip (300) is folded along the axis (306) lying in the plane of the strip (300) along a line that transverses the width (302) of the strip (300). The fold axis (306) is located about half-way along the length (304) of the strip (300).

Figure 5:
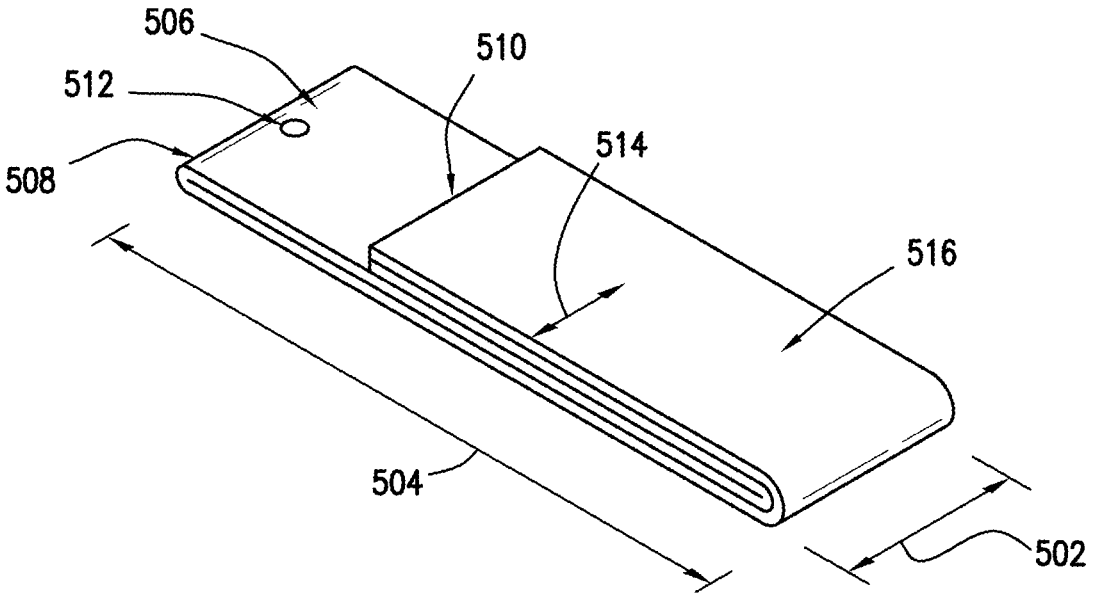

FIG. 5 shows the results of a third folding step. In the third folding step, the strip (400) is folded with a two-thirds fold to form strip (500) having a width (502) and a total length (504). In other words, the strip (400) is folded along an axis (406) lying in the plane of the strip (400) along a line that transverses the width (402) of the strip (400). This time, the axis (406) is located a distance equal to about two thirds the length (404) of the strip (400), relative to the edge (408), which corresponds to one-third the length (404) of the strip (400) relative to the edge (410).

As a result of the third folding step, also referred-to as the "two-thirds fold", exposed portion (506) is created due to the mis-alignment of the edge (508) and the edge (510). The exposed portion (506) is termed "exposed" because, at this one stage of the folding process, a portion of the paper is not overlapped by the opposing edge after the fold has been completed. The "exposed portion" (506) may also be referred to as a glue section or a glue area. The deliberate misalignment helps the final folded paper achieve its smaller size profile relative to prior symmetrical paper folding patterns. The misalignment also allows for the placement of glue spot (512) inside of the fold without increasing the thickness of the final folded product, because the thickness of the glue spot (512) will not add to the thickness of the overall folded paper since the thicknesses of the glue spot (512) is less than or equal to the thickness of the edge (510).

Thus, in one or more embodiments, glue spot (512) may be applied to the exposed portion (506) The amount of glue used for the glue spot (512) may be an amount of glue having a thickness less than the corresponding thickness of the opposing edge (510) and a total width or diameter less than the size of the exposed portion (506). However, in other embodiments, more glue could be used. Note that the location of the glue spot (512) may be varied anywhere within the boundaries of the exposed portion (506), though in the non-limiting example of FIG. 5, the glue spot (512) is about in the center of the exposed portion (506). Additionally, the location of the glue spot (512) could be varied relative to other glue spots, such as that shown in FIG. 6. Other terms could be used for "glue spot", such as "spot of glue", "dab of glue", "glue dab", or other related terms.

Figure 6:
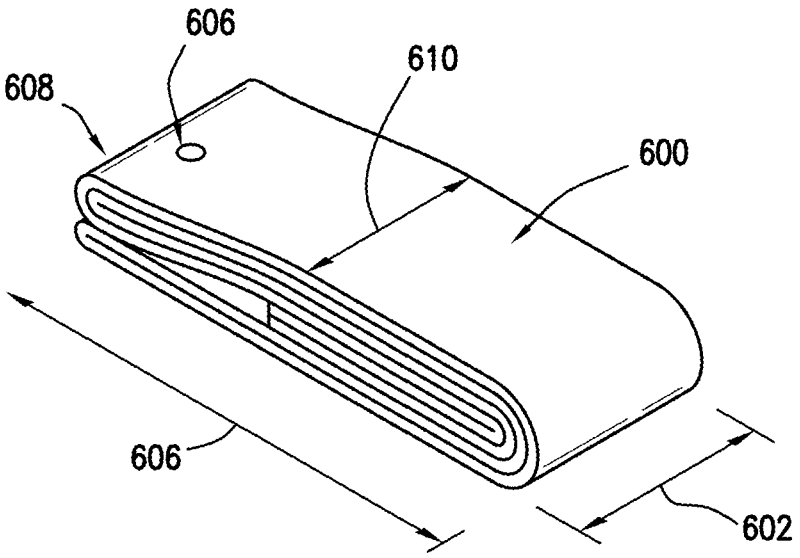

FIG. 6 shows the results of a fourth folding step. In the fourth folding step, the strip (500) is folded in half relative to the total length (504) of the strip (500) to form strip (600) of width (602) and length (604). In other words, the strip (500) is folded along a fold axis (514) lying in the plane of the strip (500) along a line that transverses the width (502) of the strip (500). The fold axis (514) is located about half-way along the total length (504) of the strip (500). As a result of the fifth folding step, the exposed portion (506) is now covered, with the glue spot (512) connecting the exposed portion (506) to the corresponding folded-over portion (516) of the strip (500).

In one or more embodiments, a second glue spot (606), may be applied near edge (608). The term "near edge" means closer to the edge (608) than to the center axis (610) of the strip (600). The amount of glue used for the glue spot (606) may be an amount of glue having a thickness less than a corresponding thickness of edge (510) of FIG. 5 and a total width or diameter less than the size of the exposed portion (506) of FIG. 5. However, in different embodiments, more glue could be used, and the amount of the glue spot (606) could be less than or more than the amount of the glue spot (512) of FIG. 5.

Figure 7A:
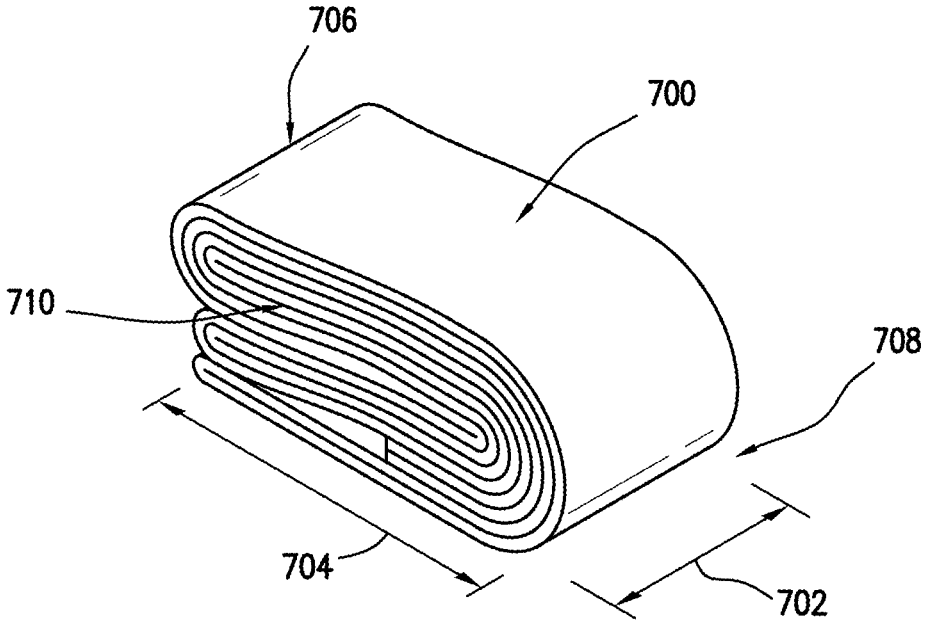

FIG. 7A shows the results of an optional fifth folding step. In the fifth folding step, the strip (600) is folded in half relative to the length (604) of the strip (600) to form strip (700) having width (702) and length (704), as well as side (706), side (708), and side (710). In other words, the strip (600) is folded along the fold axis (610) lying in the plane of the strip (600) along a line that transverses the width (602) of the strip (600). The fold axis (610) is located about half-way along the total length (604) of the strip (600).

If applied, the glue spot (606) attaches the two sides of the strip (700). Note that the location of the glue spot (606) could be varied from that shown in FIG. 6.

The exemplary folding pattern shown in FIG. 2 through FIG. 7A may include more or fewer folding steps. For example, a given half-fold may be forgone, such as the fifth folding step. In another example, additional half-folds or additional two-thirds folds may be performed after the optional fifth folding step. In other words, any surface, including the strip (700), may be further folded in one or more embodiments. Thus, the one or more embodiments are not necessarily limited to the exemplary folding pattern described above.

Figure 7B:
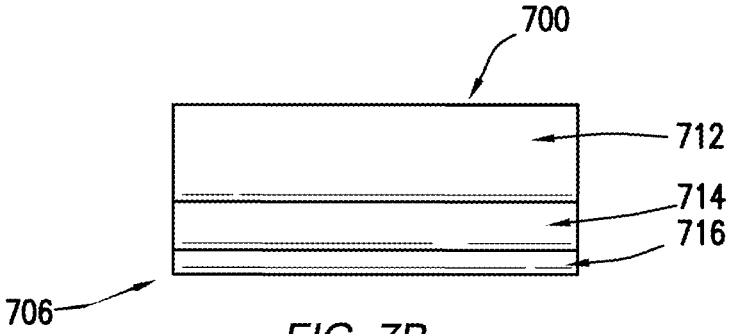
FIG. 7B, FIG. 7C, and FIG. 7D show different views of folded paper, in accordance with one or more embodiments.
Figure 7C:
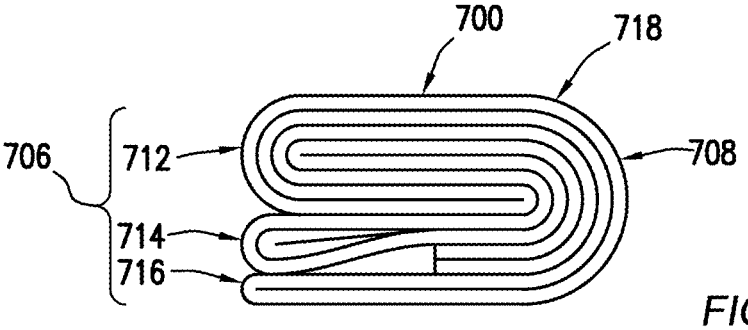
Figure 7D:
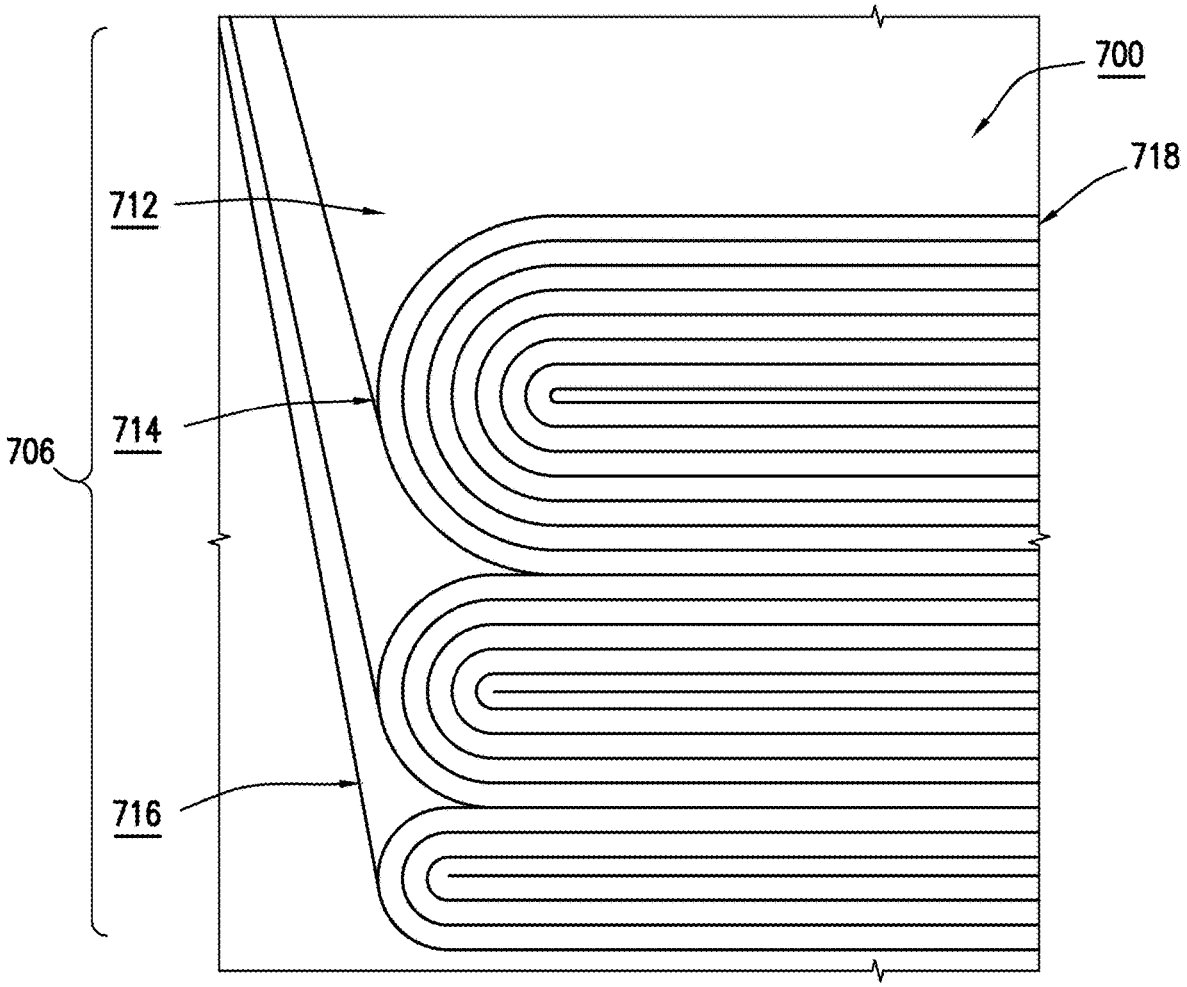

FIG. 7B through FIG. 7D show different views of compact folded paper, in accordance with one or more embodiments. In particular, FIG. 7B through FIG. 7D show strip (700) of FIG. 7A as shown from multiple different perspectives.

FIG. 7B shows a perspective view of the side (706) of the strip (700). In this perspective view, the side (706) of the strip (700) shows three edges (e.g., edge A (712), edge B (714), and edge C (716)). The three edges may be referred-to as "spines", as they are rounded and do not expose the outer edges of the sheet of paper (100) of FIG. 1. The edges are prevented from separating from each other as a result of the two dabs of glue applied as described above.

FIG. 7C shows a perspective view of the side (710) of the strip (700). In this perspective view, the three edges (e.g., edge (712), edge (714), and edge (716)) of the side (706) is shown. The thickness of the side (706) is about the same as the thickness as the side (708). However, in contrast to the side (706), the side (708) is a single rounded edge. Additionally, FIG. 7C shows the fold pattern created in the edge (718) of the sheet of paper (100) shown in FIG. 1.

FIG. 7D shows a perspective view of the side (706) of the strip (700). In this view, the three edges (e.g., edge (712), edge (714), and edge (716)) are shown, as well as a more detailed perspective view of the edge (718) of the sheet of paper (100) shown in FIG. 1. Additionally, the thickness of the edge (712) is shown to be less than the thickness of the edge (714), which in turn is less than the thickness of the edge (716).

Figure 7E:
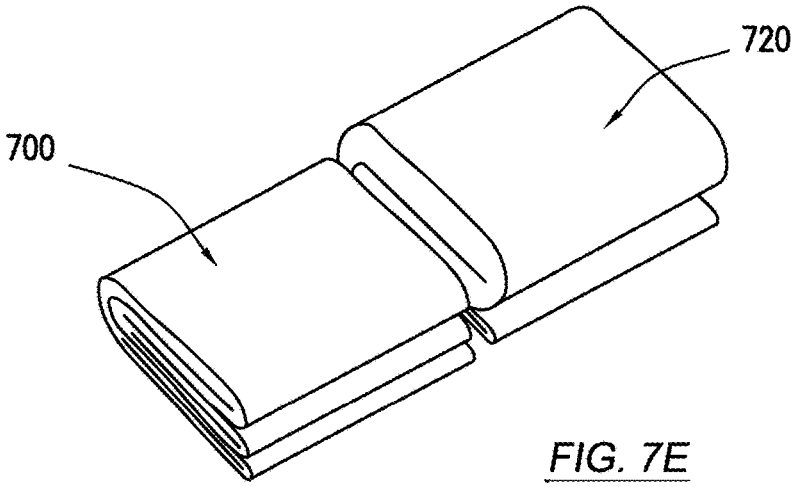
FIG. 7E shows a size comparison between paper folded according different techniques, in accordance with one or more embodiments.

FIG. 7E shows a size comparison between paper folded according different techniques, in accordance with one or more embodiments. In particular, FIG. 7E shows a contrast between a sheet of paper folded according to standard industry techniques verses a sheet of paper folded according to the embodiments described herein with additional glue spots. Strip (700) in FIG. 7E corresponds to the strip (700) shown in FIG. 7A through FIG. 7D, and corresponds to the sheet of paper (100) shown in FIG. 1. Strip (720) in FIG. 7E also corresponds to the sheet of paper (100) shown in FIG. 1. However, the strip (720) in FIG. 7E was folded without the folding technique and without the glue spot on the second folding strip, as described above. As shown in FIG. 7E, the thickness of the strip (700) is less than the thickness of the strip (720). Note, also, the three spines in the strip (700) versus the two spines in the strip (720).

Thus, the compact folding pattern described with respect to FIG. 2 through FIG. 7A results in a final strip that is not as thick as (e.g., more compact than) prior, non-compact folding and gluing techniques. In other words, when the sheet of paper (100) of FIG. 1 is folded according the folding pattern utilizing the additional glue spot (512) shown in FIG. 5 with respect to FIG. 1 through FIG. 7A, the result is to more compactly fold the sheet of paper (100).

Figure 8:
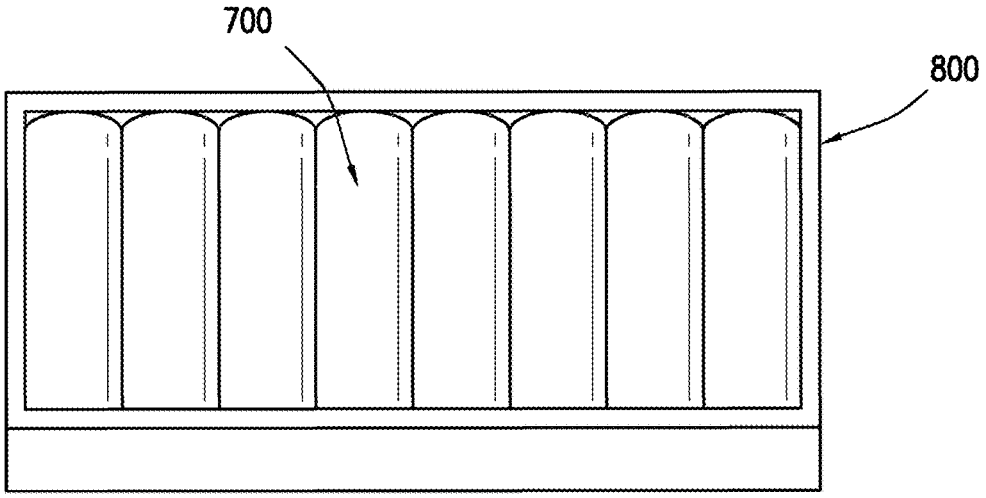
FIG. 8 shows folded sheets of paper in a container, in accordance with one or more embodiments.

FIG. 8 shows folded sheets of paper in a tray, in accordance with one or more embodiments. Strip (700) corresponds to the strip (700) in FIG. 7A. Other strips folded according to the same folding pattern are packed into a container (800). As a result of the folding pattern shown in FIG. 1 through FIG. 7A, more total strips can be placed in the container (800) relative to strips folded according to older folding patterns and gluing methods. The container (800) may be a box, a shelf, the top of a canister, or any other convenient holding container. Note that it is not necessary to place the folded paper in a container. In an embodiment, the folded paper products may be bound together, such as by using a rubber band, or may simply be placed loosely in a bin or on a shelf.

Figure 9:
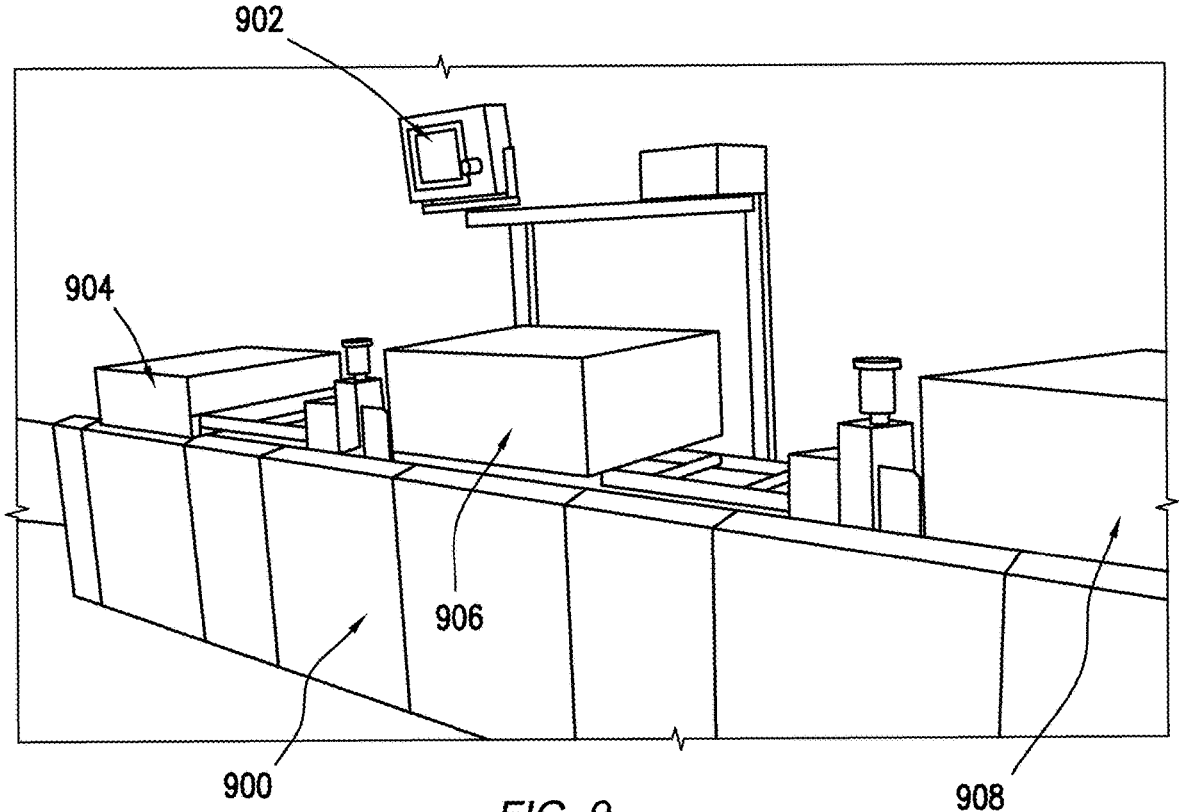
FIG. 9 shows a paper folding machine, in accordance with one or more embodiments.

FIG. 9 shows a paper folding machine, in accordance with one or more embodiments. A folding machine (900) includes a computer (902), which controls multiple folding stations, such as station A (904), station B (906), and station C (908). At each station, one or more folds such as the folding steps described above may be performed. In a station paper may be folded at various angles, such as at ninety-degree angles, by passing the paper to different stations in the folding machine (900), with those stations oriented at different angles with respect to one another so that the paper is folded as desired for a given folding step. Thus, in some embodiments, it is not necessary to ever turn the paper itself.

The folding pattern described above with respect to FIG. 1 through FIG. 7A has advantages besides saving space, as described with respect to FIG. 8. In particular, the folding pattern described with respect to FIG. 1 through FIG. 7A requires fewer total folding steps than older folding patterns. Thus, for example, station C (908) might be eliminated as being unnecessary. As a result, the process of folding many sheets of paper into strips, like the strip (700) of FIG. 7A, is faster and uses less total machinery. Accordingly, not only is less machinery required, more total sheets of paper can be processed in the same period of time with a proportionally lower chance of paper jams and machine malfunction because fewer stations are needed.

A specific, non-limiting example is now given. In this example, a sheet of paper is about 68 centimeters in length (about 27 inches) by about 48 centimeters in width (about 19.25 inches) and about 50 micrometers thick (0.002 inches). The final dimensions of the folded sheet of paper are to be about 4 centimeters wide (about 1.5 inches) and about 4 centimeters long (about 1.5 inches). However, the thickness of the folded sheet of paper will be different for the new folding method versus the old folding method. A total of 1,053,000 sheets of paper are to be folded using both the new folding pattern and an older folding pattern.

Using an older folding pattern, a total of three folding stations are used for the machine (900) shown in FIG. 9. The total setup time for operation of the machine is about 30 hours. The machine (900) processes about 2,500 sheets of paper per hour, thereby requiring a total run time of 421.2 hours (about 17.5 days) of continuous operation. A total of 26 pallets are formed, each holding about 40,500 pieces of folded paper. The thickness of the folded pieces of paper is about 1.8 centimeters (about ⅝ inches).

Using the new compact folding pattern described above with respect to FIG. 1 through FIG. 7A, only two folding stations are used for the machine (900) in FIG. 9. The total setup time for the machine is about 8 hours. The machine (900) processes 5,000 sheets of paper per hour, thereby requiring a total run time of 210.6 hours (about 8.8 days) of continuous operation. A total of 23 pallets are formed, having about 45,780 pieces of folded paper. The thickness of the folded pieces of paper is about 1.5 centimeters (about 0.5 inches—approximately 34% less thick than using the old method).

Thus, in this example, setup efficiency is improved by 375%, runtime efficiency is improved by 100%, product storage space efficiency is increased by about 34%, and 50% fewer machine stations are required. Additionally, the use of fewer machine stations results in less machine maintenance and a corresponding lower probability of paper jams or other malfunctions.

Figure 10:
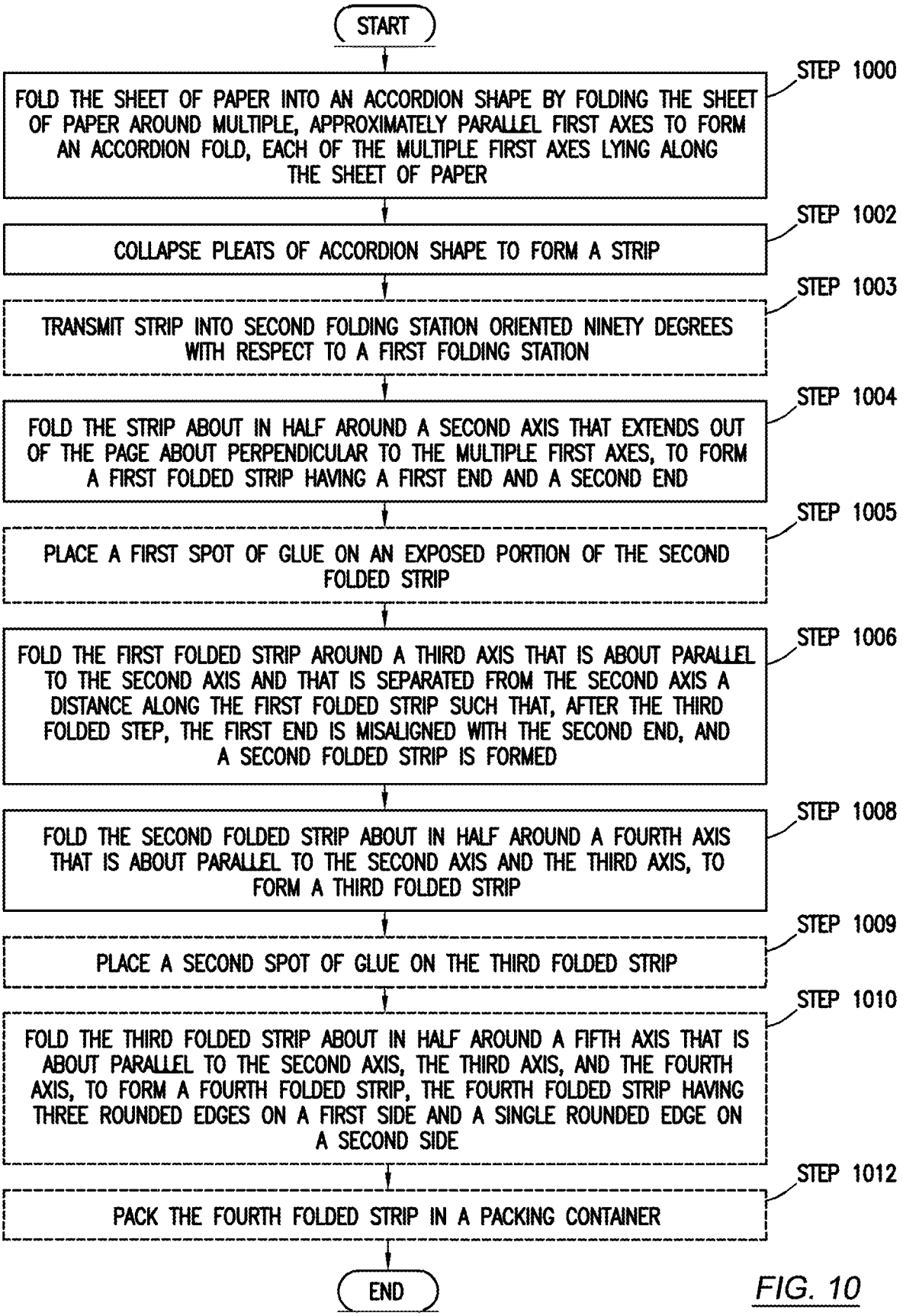
FIG. 10 and FIG. 11 are flowcharts illustrating paper folding techniques, in accordance with one or more embodiments.
Figure 11:
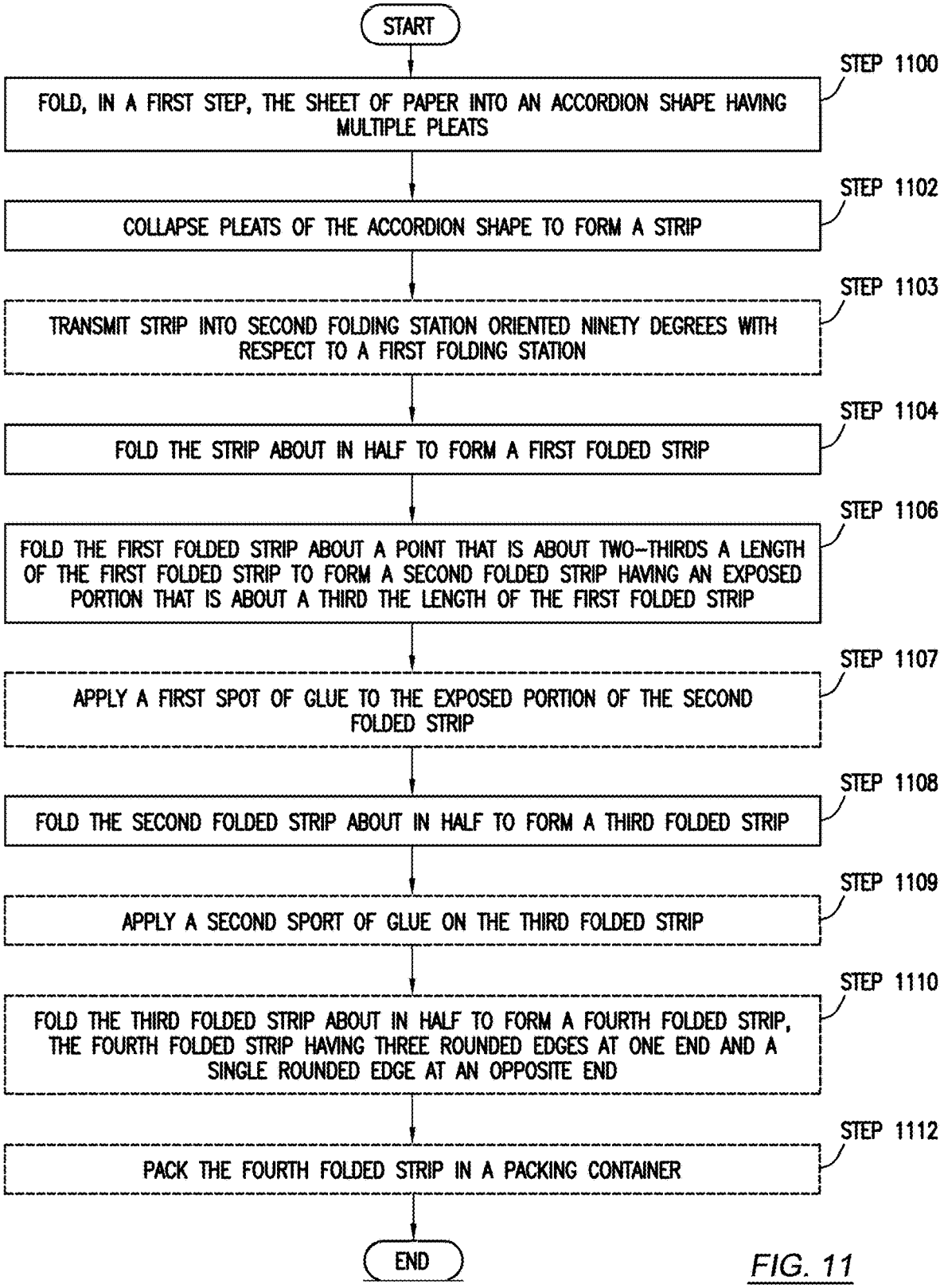

FIG. 10 and FIG. 11 are flowcharts illustrating a paper folding method, in accordance with one or more embodiments. The two methods described in FIG. 10 and FIG. 11 refer to the same folding pattern described with respect to FIG. 1 through FIG. 7A; however, FIG. 10 describes the method using the axes shown in FIG. 1 and FIG. 11 describes the method without reference to the axes shown in FIG. 1. The methods of FIG. 10 and FIG. 11 may be implemented using a paper folding machine, such as that shown in FIG. 9.

Turning to FIG. 10, the sheet of paper is folded into an accordion shape by folding the sheet of paper around multiple, approximately parallel first axes to form an accordion fold, each of the multiple first axes lying along the sheet of paper (Step 1000). Step (1000) may be characterized as a first folding step. In step (1002), the pleats of the accordion shape are collapsed to form a strip, which in some embodiments may be considered part of the first folding step. In step (1004), the strip is folded about in half around a second axis that extends out of the page about perpendicular to the multiple first axes, to form a first folded strip having a first end and a second end. Step (1004) may be characterized as a second folding step.

In step (1006), the first folded strip is folded around a third axis that is about parallel to the second axis and that is separated from the second axis a distance along the first folded strip such that, after the third folding step, the first end is misaligned with the second end, and a second folded strip is formed. Step (1006) may be characterized as a third folding step.

In step (1008), the second folded strip is folded about in half around a fourth axis that is about parallel to the second axis and the third axis, to form a third folded strip. Step (1008) may be characterized as a fourth folding step. In one embodiment, the method may terminate thereafter.

However, the method may also include additional steps. For example, in optional step (1010), the third folded strip may be folded about in half around a fifth axis that is about parallel to the second axis, the third axis, and the fourth axis, to form a fourth folded strip, the fourth folded strip having three rounded edges on a first side and a single rounded edge on a second side. Step (1010) may be characterized as a fifth folding step.

Still further steps are possible. For example, in step (1005), the method optionally may also include: after the third folding step and prior to the fourth folding step, placing a first spot of glue on an exposed portion of the second folded strip. Additionally, in step (1009), the method may optionally include: after the fourth folding step and prior to the fifth folding step, placing a second spot of glue on the third folded strip.

Additional variations to the method of FIG. 10 are possible. For example, the third folding step (step (1006)) may be folding so that about a third of the first folded strip includes an exposed portion and about two-thirds of the first folded strip is folded over. Optionally, in step (1003), the strip is transmitted into a second folding station oriented ninety degrees with respect to a first folding station of a folding machine. Alternatively, the strip itself may be turned ninety degrees. In either case, the amount of turn may vary from ninety degrees in some embodiments. Optionally, in step (1012), the fourth folded strip is packed in a packing container.

Turning to FIG. 11, a flowchart shows another method of folding a sheet of paper. In step (1100), the sheet of paper is folded into an accordion shape having multiple pleats. In step (1102), the pleats are collapsed to form a strip. In step (1104) the strip is folded about in half to form a first folded strip.

In step (1106), the first folded strip is folded about a point that is about two-thirds a length of the first folded strip to form a second folded strip having an exposed portion that is about a third the length of the first folded strip. In step (1108), the second folded strip is folded about in half to form a third folded strip.

The method of FIG. 11 may be varied to include more or fewer steps. For example, in step (1110), the third folded strip is folded about in half to form a fourth folded strip, the fourth folded strip having three rounded edges at one end and a single rounded edge at an opposite end.

In another example, in step (1107), a first spot of glue may be applied to the exposed portion of the second folded strip. Additionally, in step (1109), a second spot of glue may be applied on the third folded strip.

In still another example, in step (1103), the strip is transmitted into a second folding station oriented ninety degrees with respect to a first folding station of a folding machine. The angle may vary from ninety degrees in some embodiments. In yet another example, in step (1112), the fourth folded strip may be packed in a packing container.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

folding a sheet of paper into an accordion shape comprising a plurality of pleats and collapsing the pleats to form a strip;

folding the strip about in half to form a first folded strip;

folding the first folded strip about a point that is about two-thirds a length of the first folded strip to form a second folded strip comprising an exposed portion that is about a third the length of the first folded strip;

before folding the second folded strip, applying a first spot of glue to the exposed portion of the second folded strip;

folding the second folded strip about in half to form a third folded strip;

before folding the third folded strip, applying a second spot of glue on the third folded strip;

folding the third folded strip about in half to form a fourth folded strip.

2. The method of claim 1, wherein folding the sheet of paper into an accordion shape and collapsing the pleats is performed in a first folding station of a folding machine, and wherein the method further comprises:

after collapsing the pleats and before folding the strip, sending the strip into a second folding station for folding the strip, the second folding station being oriented orthogonally to the strip;

applying the first spot of glue before the folding the third folded strip.

3. The method of claim 1, wherein folding the sheet of paper into an accordion shape and collapsing the pleats is performed in a first folding station of a folding machine, and wherein the method further comprises:

after collapsing the pleats and before folding the strip, sending the strip into a second folding station for folding the strip, the second folding station being oriented orthogonally to the strip.

4. The method of claim 1, wherein the fourth folded strip comprises three rounded, outer edges at one end and a single rounded outer edge at an opposite end.

5. The method of claim 1, further comprising:

attaching the fourth folded strip to a container.

6. The method of claim 5, wherein the container holds medication.

7. A product created according to a process comprising:

folding a sheet of paper into an accordion shape comprising a plurality of pleats and collapsing the pleats to form a strip;

folding the strip about in half to form a first folded strip;

folding the first folded strip about a point that is about two-thirds a length of the first folded strip to form a second folded strip comprising an exposed portion that is about a third the length of the first folded strip;

before further folding, applying a first spot of glue to the exposed portion of the second folded strip;

folding the second folded strip about in half to form a third folded strip;

before further folding, applying a second spot of glue on the third folded strip; and folding the third folded strip about in half to form a fourth folded strip.

8. The product of claim 7, wherein folding the sheet of paper into an accordion shape and collapsing the pleats is performed in a first folding station of a folding machine, and wherein the method further comprises:

after collapsing the pleats and before folding the strip, sending the strip into a second folding station for folding the strip, the second folding station being oriented orthogonally to the strip.

9. The product of claim 7, wherein the fourth folded strip comprises three rounded, outer edges at one end and a single rounded outer edge at an opposite end.

10. The product of 7, wherein the method for creating the product further comprises:

attaching the fourth folded strip to a container.

11. The product of claim 10, wherein the container holds medication.

12. A product comprising:

a sheet of folded paper comprising:

an accordion fold, wherein the accordion fold comprises a strip of a plurality of collapsed pleats, a first fold around about a center of the strip, a second fold within the first fold at about a two-thirds of a first length of the first fold of the strip, a third fold within the second fold at about a half of a second length of the second fold of the strip;

a first spot of glue within the third fold, a fourth fold within the third fold at about a half of a third length of the third fold of the strip, and a second spot of glue within the fourth fold.

13. The product of claim 12, wherein, when folded, a first end of the sheet of folded paper comprises three rounded outer edges and a second, opposite end of the sheet of folded paper comprises a single rounded outer edge.

14. The product of claim 13 wherein the three rounded outer edges comprise a total first thickness about equal to a second thickness of the single rounded outer edge.

15. The product of claim 12, wherein the sheet of folded paper further comprises a fifth fold within the fourth fold at about a half of a fourth length of the fourth fold.

16. The product of claim 12, wherein the second fold further comprises an exposed portion that is about a third the length of the first fold, and wherein a gap is disposed between part of the exposed portion and an end of the third fold.

17. The product of claim 12, wherein the sheet of paper, prior to folding, is about 68 centimeters by about 48 centimeters.

18. The product of claim 12, wherein a final pleat of the accordion fold has a width less than other pleats of the accordion fold.

19. The product of claim 12, wherein a first thickness of the first spot of glue is less than or equal to a thickness of an edge of the first fold.

20. The product of claim 12, further comprising:

a third spot of glue on the fourth fold.

* * * * *